United States Patent [19]

Walther

[11] Patent Number: 4,515,098

[45] Date of Patent: May 7, 1985

[54] DEVICE FOR DRIVING A SEWING MACHINE

[75] Inventor: Karl-Heinz Walther, Weilerbach, Fed. Rep. of Germany

[73] Assignee: Pfaff Industriemaschinen GmbH, Fed. Rep. of Germany

[21] Appl. No.: 411,512

[22] Filed: Aug. 25, 1982

[30] Foreign Application Priority Data

Aug. 25, 1981 [DE] Fed. Rep. of Germany ... 8124815[U]

[51] Int. Cl.[3] ..... D05B 69/22; D05B 69/16; D05B 69/08; D05B 55/14

[52] U.S. Cl. ..... 112/274; 112/276; 112/221

[58] Field of Search ..... 112/221, 274, 276

[56] References Cited

U.S. PATENT DOCUMENTS

| | | | |
|---|---|---|---|
| 1,850,708 | 3/1932 | Davis | 112/276 |
| 2,159,722 | 5/1939 | Bedard | 112/274 |
| 2,969,755 | 1/1961 | Reece | 112/274 X |
| 3,026,835 | 3/1962 | Hall | 112/221 |
| 3,170,425 | 2/1965 | Becker | 112/220 |

FOREIGN PATENT DOCUMENTS

| | | | |
|---|---|---|---|
| 910023 | 4/1954 | Fed. Rep. of Germany . | |
| 1132139 | 10/1968 | United Kingdom | 112/274 |
| 357300 | 12/1972 | U.S.S.R. | 112/274 |

*Primary Examiner*—Wm. Carter Reynolds
*Attorney, Agent, or Firm*—McGlew and Tuttle

[57] ABSTRACT

A device for driving a sewing machine which includes a main shaft driven by a positioning motor that can be stopped in at least one predetermined position and then returned back to a second predetermined position, comprises a coupling disc which can be moved into engagement with a drive disc associated with the motor and a main shaft to drive the main shaft in a direction opposite to its normal direction of operation as determined by the positioning motor. The coupling disc is provided with cam surfaces with a cam engaging surface provided on a supporting member which is biased toward the disc by a predetermined tension. An actuator is connected to the support for rotating the actuator. The initial rotation moves the coupling disc into engagement with the driver disc which is connected to the main shaft, and the further rotation of the support rotates both the coupling and main shaft by a predetermined amount. A predetermined positioning of the actuator determines the amount of rotation of the coupling disc and therefore the main shaft.

9 Claims, 4 Drawing Figures

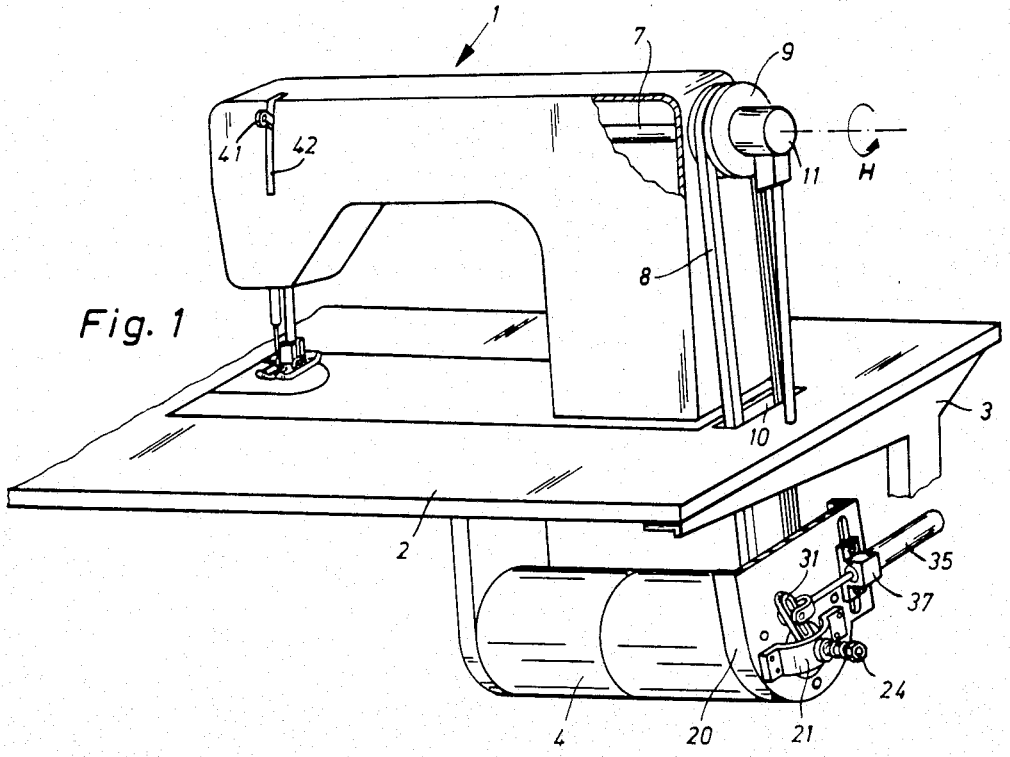
Fig. 1
Fig. 2
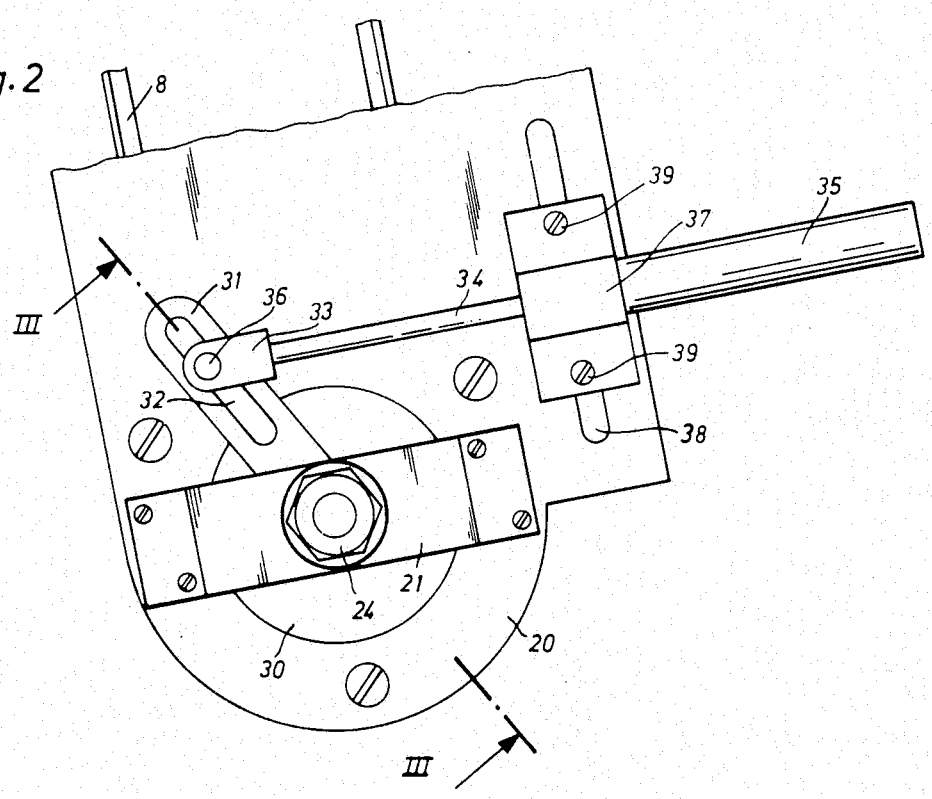

DEVICE FOR DRIVING A SEWING MACHINE

FIELD AND BACKGROUND OF THE INVENTION

The present invention relates in general to sewing machines and in particular to a new and useful device for moving the main shaft of a sewing machine to a predetermined position after the sewing machine has come to a stop.

In some instances, after stopping a sewing machine in a certain position, for example with the needle in its uppermost or lowermost position, it is desired to turn the main shaft back, through a certain angle, into another position. For example, if in a chain stitch sewing machine, the rotary hook or looper has engaged the needle thread loop and the needle is in its uppermost position, the looper must be disengaged to be able to remove the work without hindrance.

In lock stitch sewing machines, the take-up lever in its upper return zone lags the needle bar by about 30° of rotation of the main shaft, i.e. the needle bar, after having passed its uppermost position, already moves downwardly while the take-up lever still moves upwardly. Because of this fact, which is required by the sewing technique, and since the thread is neither clamped nor otherwise retained after the sewing machine has been stopped and after the thread has been cut, with the needle in its uppermost position, upon restarting the sewing machine, the thread is pulled out of the needle eye by the upwardly moving take-up lever, and restarting of the sewing operation may be delayed by the necessity of threading the needle again. Therefore, frequently, the uppermost position of the take-up lever is chosen as the stopping position after the thread cutting operation. Since, however, at this point the needle bar is already moved a certain distance downwardly, in many instances the clear space below the needle becomes insufficent for an unhindered removal or insertion of the work. The operator must use the handwheel and turn the machine back through a certain angle into the upper position of the needle. This is a time-consuming complication.

German Pat. No. 910,023 discloses a sewing machine drive, where for stopping the machine in predetermined positions, the main shaft of the sewing machine first is brought from a full speed rotation to a lower speed at which it rotates up to a predetermined position and stops, whereupon it is automatically turned back through a certain angle and again stopped. The speed and reversal are effected directly by the drive motor which is equipped with an electron tube control. Such a drive is relatively complicated and the electronic control is rather susceptible to disturbances.

Another drive disclosed in German Pat. No. 1,438,338 U.S. Pat. No. 3,170,425 comprises a coupling motor with a permanently rotating main drive disc and an axially displaceable coupling disc which is operatively connected to the sewing machine and, after being disengaged from the main disc, can be brought into operative connection with an auxiliary drive, to be further rotated into a predetermined position in which the machine is stopped.

To rotate the sewing machine shaft automatically back through a certain angle and stop it again, a second auxiliary drive is provided at the shaft of the first auxiliary drive, which is equipped with an electromagnetic clutch and a brake and rotates oppositely to the first auxiliary drive. The operation of the clutches and brakes of the two auxiliary drives is such that to stop the sewing machine for the first time, the clutch of the first auxiliary drive is disengaged and simultaneously the brakes of both the auxiliary drives are engaged. At that point the clutch of the second auxiliary drive is engaged while simultaneously disengaging the brakes of both of the auxiliary drives, and is disengaged again, with a simultaneous engagement of the brakes of both of the auxiliary drives, as soon as the predetermined return position of the shaft of the sewing machine is reached.

The clutches of the two auxiliary drives may be operatively connected through belt drives to the coupling motor or to auxiliary motors.

The stop after return is effected through an additional sliding contact ring with a point of interruption, of a synchronizer which is usually provided in drives of this kind. This drive arrangement works satisfactorily, however, the second auxiliary drive and its control make the construction rather expensive.

SUMMARY OF THE INVENTION

Since not all sewing machines or sewing operations require such as expensive drive as taught by the above-discussed German Patent, the present invention is directed to a sewing machine drive using simple and inexpensive component parts for returning the sewing machine from a predetermined stop position through a certain angle into another stop position, which parts are not constituents of the drive motor and can be provided subsequently in any sewing machine which is driven by a positioning motor.

Accordingly an object of the present invention is to provide a device for driving a sewing machine having a main shaft which is driven by a positioning motor and which can be stopped in at least one first predetermined position for moving the main shaft into a second predetermined position, comprising a coupling disc which can be moved into engagement with a member connected to the main shaft, the coupling disc being drivable in a direction opposite to the usual direction of rotation of the main shaft, a cam surface defined on the coupling disc and a supporting part carrying a cam engaging surface engageable with the cam surface, the supporting part provided for carrying the coupling disc and being movable to first engage the coupling disc with the member connected to the main shaft and then further rotatable to rotate the main shaft.

A further object of the present invention is to provide an actuator which is linked to the supporting part and is connected at various fixed locations with respect to the sewing machine to permit various amounts of rotations for the coupling disk to change the second predetermined position.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the following, two embodiments of the invention are described in more detail with reference to the drawings in which:

FIG. 1 is a perspective view of a sewing machine which is driven by a positioning motor;

FIG. 2 shows the inventive drive as arranged on the belt guard of the machine;

DESCRIPTION OF THE PREFERRED EMBODIMENTS

Figure 3:
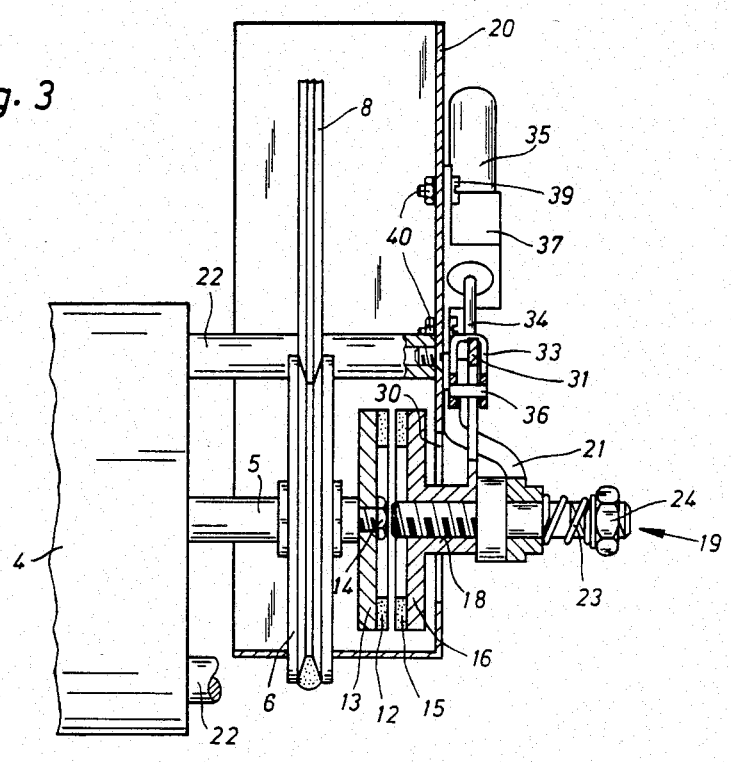
FIG. 3 is a sectional view taken along the line III—III of FIG. 2, showing the first embodiment of the invention.
Figure 4:
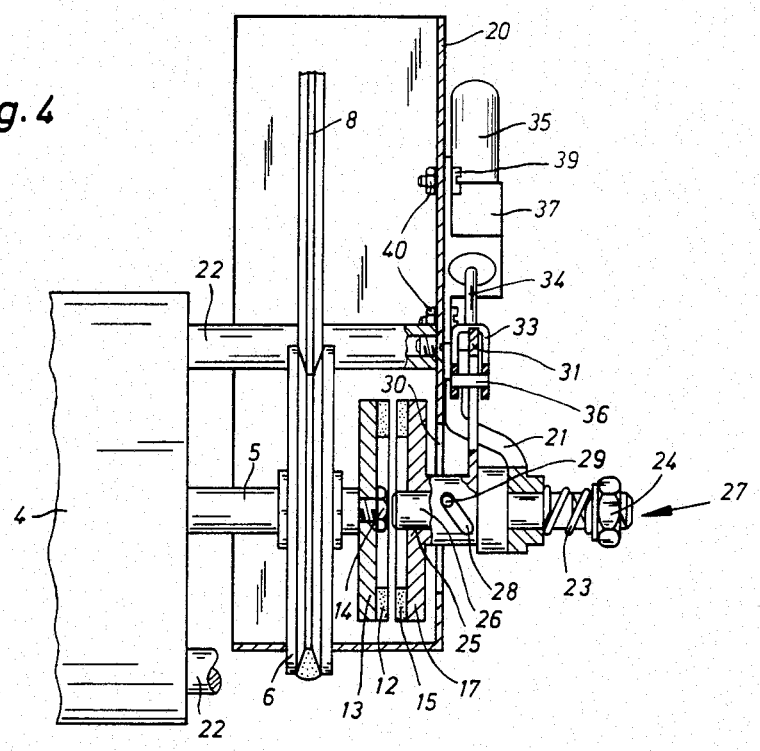
FIG. 4 is a view similar to FIG. 3, showing another embodiment of the invention.

Referring to the drawings in particular, the invention, as shown in FIG. 1, is included in a sewing machine 1, equipped with a well-known thread cutting device, and seated in a cutout of a bed plate 2 which is supported on a machine frame 3. Mounted on the underside of bed plate 2 is a positioning motor 4 of known design carrying the V-belt pulley 6 on its output shaft 5 as shown in FIGS. 3 and 4. The force of motor 4 is transmitted to the main shaft 7 of the sewing machine 1 by an endless V-belt 8 which is entrained around a pulley 9 secured to main shaft 7 and extends through a slot 10 in bed plate 2. The output 5, pulleys 6 and 9, and belt 8 form transmission means for rotating the main shaft 7 using the motor 4. On the main shaft and projecting from the machine housing, a synchronizer 11 is mounted which is connected in the control circuit of positioning motor 4 and by which sewing machine 1 can be stopped in predeterminable angular positions of main shaft 7, corresponding, for example, to the uppermost and lowermost positions of the needle and to the uppermost position of the take-up lever 41.

To the free front end of output shaft 5 of positioning motor 4 a driver disc 13 provided with a friction facing 12 is secured by a screw 14. Driver disc 13 can be engaged with a coupling disc 16 (FIG. 3) or 17 (FIG. 4) which also is coated with a friction facing 15. Coupling disc 16, shown in FIG. 3, is provided with a central taphole 18 which acts as a cam surface for a supporting part 19 which is designed as a threaded spindle and mounted for rotary motion in a bracket 21 secured to belt guard 20. Part 19 thus forms a cam engaging surface. Guard 20 is secured to the housing of position motor 4, with the interposition of spacer rods 22. To be able to exert a variable braking force on supporting part 19, a compression spring 23 is provided on the free end of part 19, between bracket 21 and an adjusting nut 24.

The coupling disc 17 shown in FIG. 4, is provided with an axial bore 25 for a cylindrical portion 26 of supporting part 27 which, in the same manner as part 19 of FIG. 3, is mounted for rotary motion in bracket 21 and loaded by compression spring 23 with an adjustable braking force. At least one oblique slot 28 is provided in coupling disc 17 which acts as a cam surface and into which a pin 29 of supporting part 27 engages. Pin 29 carries a cam engaging surface that follows cam surface 28. Due to the cooperation of threaded spindle 19 with taphole 18, or of oblique slot 28 with pin 29, upon being turned, coupling disc 16 or 17 is moved axially. Bracket 21 can be thought of as part of the guard 20.

To actuate coupling disk 16 or 17, a lever arm 31 having an oblong slot 32 is provided on the hub end of the coupling disc, projecting outwardly from guard 20 through an opening 30. A pin 36 secured to the fork head 33 of the piston rod 34 of an air cylinder 35 acting against a return spring, extends through slot 32. Air cylinder 35 is received in a block 37 which is secured to guard 20 by screws 39 and nuts 40 extending through a slot 38 of the guard, and is adjustable radially relative to supporting part 19, 27 so that the angle through which coupling disc 16, 17 is turned by a constant stroke of piston rod 34 of air cylinder 35 can be varied (see FIG. 2).

To control the sewing thread, the known take-up lever 41 is provided which projects from the sewing machine housing through a slot 42 (FIG. 1).

The device operates as follows:

In order to prepare for the cutting of a thread, sewing machine 1 is stopped at the end of a seam with the needle in its lowermost position, and then started again by the operator for about ½ a revolution of main shaft 7, to initiate the cutting operation. During this partial turning of main shaft 7, the rotary hook (not shown) executes a complete revolution. The threads to be cut are shaped by the thread catcher (not shown), moved to a knife (not shown) and cut. Then, sewing machine 1 is stopped in the uppermost position of take-up lever 41.

At that time, the needle bar of sewing machine 1 has already passed beyond its uppermost return position and moved downwardly through a certain distance, so that the clearance between the needle point and the needle plate is smaller than with the needle in its uppermost position and the handling of the work would be hindered. Therefore, air cylinder 35 is supplied with compressed air, to return the needle into its uppermost position. Piston rod 34 of air cylinder 35 moves against the action of its return spring (not shown) provided in the cylinder casing and turns coupling disc 16 or 17 through lever arm 31 in the clockwise direction, as viewed in FIG. 2, with supporting part 19 designed as a threaded spindle, or supporting part 27, standing still at the start of this rotary motion, under the effect of braking spring 23, so that initially, coupling disk 16 or 17 executes a rotary motion relative to supporting part 19 or 27. During this starting phase of its rotary motion, and due to the cooperation of threaded spindle 19 with tap hole 18 of coupling disk 16, or of pin 29 of supporting bar 27 with oblique slot 28 of coupling disc 17, coupling disc 16 or 17 is axially displaced and engaged with driver disc 13, thereby effecting the coupling. During the further rotary motion, in which supporting part 19 or 27 is also rotated (against the braking effect), the main shaft 7 of sewing machine 1 is turned, through driver disc 13, V-belt pulley 6 secured to output shaft 5, V-belt 8, and pulley 9, in a direction opposite to its main direction of rotation H in FIG. 1, back into the uppermost position of the needle, in which the motion of the sewing machine is again stopped but in a new position. Thus, as piston rod 34 moves to its full stroke, it rotates lever arm 31 through its full stroke. Through part of the full stroke of lever arm 31, support parts 19 or 27 are held by the effect of braking spring 23, and prevented from rotating. Through the remainder of the stroke of lever arm 31, the braking effect of spring 23 is overcome (do to the fact that friction surfaces 12 and 15 are now engaged with each other) and the supporting parts 19 or 27 rotate with the movement of lever arm 21. This rotation of supporting part 19 or 27 causes the rotation of driver disc 13, which in turn causes the sewing machine to move in the reverse direction sufficiently to lift the needle into its uppermost position. It should be recalled that when the sewing machine was originally stopped with the take-up lever 41 in its uppermost position, needle bar had already begun to descend to a position below the uppermost position of the needle bar.

By varying the radial distance between air cylinder 35 and supporting part 19 or 27, and thus the point of application (pin 36) of piston rod 34 on lever arm 31 of coupling disc 16 or 17, the angle through which the coupling disc is turned can be adjusted exactly so that the new stopping position of sewing machine 1 can be controlled with precision.

As drive motor 4 is switched off in the uppermost position of the needle, the supply of compressed air into cylinder 35 is also interrupted whereupon the return spring of this cylinder returns coupling disc 16 or 17 into their initial positions.

While specific embodiments of the invention have been shown and described in detail to illustrate the application of the principles of the invention, it will be understood that the invention may be embodied otherwise without departing from such principles.

What is claimed is:

1. A device for driving a sewing machine from at least one predetermined stop position to at least one second predetermined position, the sewing machine having a main shaft, a positioning motor and transmission means connected between the main shaft and the motor for rotating the main shaft in a forward drive direction, the motor being operable for stopping the main shaft at the first position, comprising:

a driver disc connected to the transmission means;

a coupling disc movably mounted with respect to the sewing machine and engageable with said driver disc;

a supporting part movably mounted with respect to the sewing machine for movably carrying said coupling disc;

a cam surface defined on said coupling disc and fixed relative thereto;

a cam engaging surface defined on said supporting part and engaged with said cam surface for movement of said coupling disc into engagement with said driver disc upon relative movement between said support part and said coupling disc; and drive means connected to said coupling disc for moving said coupling disc to engage said driver disc with and for further moving said coupling disc to rotate driver disc and thus rotate the main shaft in a direction opposite to the forward drive direction for bringing the main shaft into the at least one second predetermined position.

2. A device according to claim 1, wherein said cam surface comprises a central threaded hole extending through said coupling disc, said cam engaging surface comprising a threaded spindle defined on said supporting part threadable engaged with said hole.

3. A device according to claim 1, wherein said coupling disc includes a hub having an axial bore extending therethrough, said cam surface comprising at least one oblique slot extending in said hub, oblique to said axial bore, said cam engaging surface comprising a pin extending from said supporting part into said oblique slot.

4. A device according to claim 1, wherein said drive means comprises a lever arm engaged with said coupling disc, a piston rod connected to said lever arm and an air cylinder connected to said piston rod for moving said piston rod to rotate said coupling disc.

5. A device according to claim 4, wherein the sewing machine includes a fixed housing, said air cylinder mounted at an adjustable radial position with respect to said coupling disc for adjusting an amount of rotation of said coupling disc and of said driver disc to adjust the second predetermined position.

6. A device according to claim 1, including a brake spring carried by said supporting part and engaged between said supporting part and a fixed part of the sewing machine and an adjustment nut engaged with said supporting part for adjusting a biasing force of said brake spring.

7. A device according to claim 6, including a belt transmission forming the transmission means and connecting the positioning motor to the main shaft, a guard covering said belt transmission and connected to the sewing machine, said brake spring engaged between said adjustment nut and said guard.

8. A device according to claim 1, wherein the transmission means includes an output shaft connected to the positioning motor, said driver disc connected to said output shaft and facing said coupling disc for engagement with said coupling disc when said coupling disc is moved by said drive means.

9. A device according to claim 1, wherein the sewing machine includes a housing, said drive means comprising a cylinder connected to said housing at an adjustable radial position with respect to said coupling disc, a piston extending from said cylinder, a lever arm extending radially outwardly from said supporting part and engaged by said piston whereby movement of said piston causes rotation of said coupling disc and relative rotation between said supporting part and said coupling disc to move said coupling disc into engagement with said driver disc through the action of said cam surface and engaging surface, and further movement of said piston causes rotation of said support part and coupling disc to rotate said driver disc and thus rotate the main shaft into the second predetermined position.

* * * * *